United States Patent [19]

Tseng

[11] 4,341,315

[45] Jul. 27, 1982

[54] MARINE DERRICK ARRANGEMENT

[76] Inventor: Tsiung-Siung Tseng, Room 707, 3-4-28, Sakurazara, Chuoku, Fukuoka City 810, Japan

[21] Appl. No.: 83,833

[22] Filed: Oct. 11, 1979

[30] Foreign Application Priority Data

Nov. 30, 1978 [JP] Japan ..... 53/149308

[51] Int. Cl.[3] ..... B66C 23/60; B66C 23/52

[52] U.S. Cl. ..... 212/193; 212/190; 212/148; 212/227; 212/262; 414/918

[58] Field of Search ..... 212/3 R, 3 A, 28, 35 R, 212/50, 54, 58 R, 58 A, 59 R, 66–70, 190; 414/918

[56] References Cited

U.S. PATENT DOCUMENTS

| | | | |
|---|---|---|---|
| 1,357,150 | 10/1920 | Curtis | 212/58 R |
| 1,706,441 | 3/1929 | Daughs | 212/3 R |
| 2,610,527 | 9/1952 | Papay | 212/68 |
| 2,807,374 | 9/1957 | McLean | 212/58 A |
| 3,477,746 | 11/1969 | Watson | 212/68 |
| 3,743,223 | 7/1973 | Spellman | 212/66 |
| 3,959,608 | 5/1976 | Finlayson et al. | 414/918 |

FOREIGN PATENT DOCUMENTS

| | | | |
|---|---|---|---|
| 340670 | 1/1931 | United Kingdom | 212/239 |
| 766593 | 1/1957 | United Kingdom | 212/197 |
| 888550 | 1/1962 | United Kingdom | 212/239 |
| 1187012 | 4/1970 | United Kingdom | 212/239 |
| 1296743 | 11/1972 | United Kingdom | 212/193 |
| 1432080 | 4/1976 | United Kingdom | 212/190 |

*Primary Examiner*—Trygve M. Blix
*Assistant Examiner*—R. B. Johnson
*Attorney, Agent, or Firm*—O'Brien & Marks

[57] ABSTRACT

Marine derrick having a horizontal turn table supporting a derrick boom, a derrick post and all winches each handling separately a cargo fall, a topping lift wire and guy pendants thereon. A guy winch is located in center portion of the turn table at a level spaced from the turn table with its vertical drive shaft extended downward through an opening provided in the turn table and connected to drive motor located below the deck. The turn table is operatively connected to the drive shaft by a train of gears.

3 Claims, 5 Drawing Figures

MARINE DERRICK ARRANGEMENT

The present invention relates to a marine derrick, more particularly to a marine derrick including a turn table having derrick post, derrick boom and all winches mounted thereon.

DESCRIPTION OF THE PRIOR ART

The prior art is generally cognizant of marine derrick arrangements including a turn table having derrick post, derrick boom and all winches mounted thereon. Examples of such marine derrick arrangement are shown in Japanese Patent Publication No. 17085/1970, Japanese Patent Publication No. 6705/1975, and Japanese Patent Laying-open Publication No. 63656/1975. At least one example is known in the art of a marine derrick arrangement having either one or both of two guy pendants connected to topping lift wire. An example of a such marine derrick arrangement is shown in U.S. Pat. No. 3,260,373. However, no prior art is known which utilizes a drive shaft of the guy winch for rotating the turn table and a tension equalizing wire for maintaining both guy pendants taut at all times.

The present invention is summarized in a marine derrick including a turn table rotatably mounted on deck and having derrick post, boom and all winches each handling separately a cargo fall, topping lift and guy pendants mounted thereon, a vertical type guy winch being spaced above the upper surface of the turn table with a vertical drive shaft thereof extending through an opening provided in center portion of the turn table and having a drive motor connected to lower end thereof, said turn table being operatively connected to said drive shaft by means of a train of gears provided between the drive shaft and the turn table.

Object of the present invention is to provide a marine derrick capable of improving efficiency of derrick boom handling operation by incorporating a turn table rotatably mounted on deck without any additional actuating means installed.

Another object of the present invention is to provide a marine derrick in which the angle of swing of the derrick boom in a horizontal plane during boom handling operation will be substantially reduced thereby to prevent undue stress from occurring in the boom.

Still another object of the present invention is to eliminate guy wires dragged along on deck during boom handling operation and also many posts erected on deck, particularly adjacent to ship's side, for handling guy wires.

Still another object of the present invention is to provide a marine derrick which is compact and free from large projections interfering with a navigation officer's view.

Other objects, advantages and features of the invention will be apparent from the following description of the preferred embodiment taken in conjunction with the accompanying drawings.

DESCRIPTION OF THE PREFERRED EMBODIMENT

Figure 1:
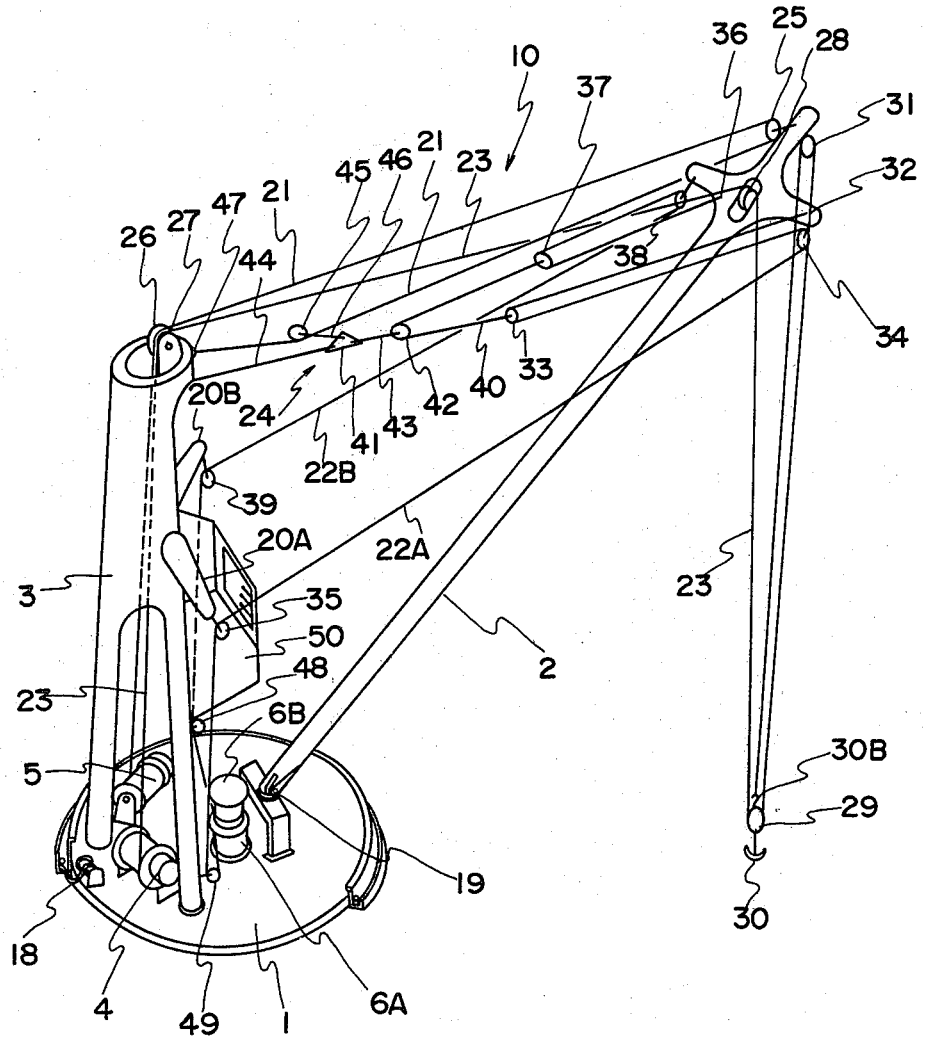
FIG. 1 is a perspective view showing a marine derrick constructed in accordance with the present invention.

Referring to FIG. 1, there is shown a marine derrick arrangement 10 according to the present invention, comprising a circular turn table 1 rotatably mounted on deck 51 and having a derrick boom 2, a derrick post 3, a cargo winch 4, a topping lift winch 5 and a guy pendant winch 6 mounted thereon.

Figure 2:
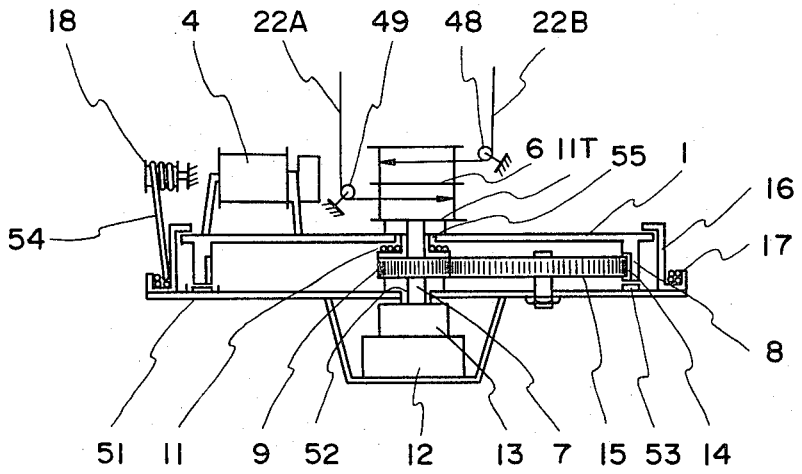
FIG. 2 is a transverse section view of turn table incorporated in the marine derrick in FIG. 1.

As shown in FIG. 2, a vertical guy pendant winch 6 of double drum type is located in center portion of the turn table 1 and spaced above the upper surface of the same. A vertical drive shaft 7 depending from the guy winch 6 is extended downward through an opening 55 provided in the centre portion of the turn table 1 and another opening 52 provided on deck 51 and is connected at its lower end to a driving motor 12 which is located below the deck 51 together with a reduction gear 13.

A support ring 11 having a vertical tubular portion 11T is fitted loosely over the vertical shaft 7 and suitably supported on the deck 51 immediately above a pinion 9 which is rotatably mounted on the shaft 7 in a predetermined level above the deck 51. The circular turn table of predetermined size is loosely fitted over the shaft 7 and is rotatably supported in the central portion thereof by the support ring 11. The turn table 1 has a vertical leg portion 8 of cylindrical shape depending from the underside of the peripheral portion. The leg portion 8 is provided at the lower end thereof with suitable rollers (not shown) running along guide rails 53 located on the deck 51. A horizontal reduction gear 15 of large diameter is rotatably mounted on the deck 51 and engaged with the pinion 9 on the vertical shaft 7. A ring gear 14 mounted on the inside surface of the leg portion 8 of the turn table 1 is engaged with the reduction gear 15. Suitable clutch means (not shown) is provided between the shaft 7 and the pinion 9. A holder or retainer ring 16 of Z-shaped cross section is mounted on the deck 51 in a position opposite the outer periphery of the turn table 1. The retainer ring 16 is provided with a grooved lower portion 17 for receiving coiled power cables 54. A winding drum 18 of tension type is mounted on the turn table 1 for taking up one end of the power cable 54, which end is suitably connected to various winches such as the the cargo winch 4 and the topping lift winch 5 on the turn table 1. The other end of the cable 54 is connected to a suitable power source.

Returning to FIG. 1, a derrick post 3 having a pair of outrigger arms 20A, 20B mounted at a predetermined height is mounted on the turn table 1 in a position spaced from the guy pendant winch 6 which is located in the central position of the turn table. A control platform 50 is mounted on the derrick post 3. The derrick boom 2 is mounted on the turn table 1 with its gooseneck member 19 rotatably supported thereon in a position adjacent to the guy winch so as to be located in a diametrically opposite position with respect to the derrick post 3.

A topping lift wire 21 having one end connected to an eye plate 47 on top of the derrick post 3 is entrained around a sheave 45, which is to be described hereinafter, passes around a sheave 25 on top of the derrick boom 2 and another sheave 26 on top of the derrick post 3 and led to the topping lift winch 5 on the turn table 1.

A cargo fall 23 having one end connected to a becket 30B on a cargo block 29 having a cargo hook 30 depending therefrom, is led upwardly, entrained around a sheave 31 on top of the derrick boom 2, led downwardly, entrained about the cargo block 29, led upwardly, passes around a sheave 28 on the derrick boom 2 adjacent to the top end and another sheave 27 on top of the derrick post 3, and then led to the cargo winch 4.

One side guy pendant 22A having one end connected to eye plate 32 on the top end of the derrick boom 2 is entrained around a sheave 33, which is to be described hereinafter, led to a sheave 34 on the top end of the boom 3, another sheave 35 on a outrigger member 20A and still another sheave 49 on the derrick post 3 and then wound around one drum 6A of the guy winch 6 in a predetermined direction. Similarly, the other side guy pendant 22B having one end connected to eye plate 36 on the top end of the boom 2 is entrained around a sheave 37, which is to be described hereinafter, led to a sheave 38 on the top end of the boom 2 and another sheave 39 on outrigger member 20B and still another sheave 48 on the derrick post 3, and then wound around the other drum 6B of the guy winch 6 in a direction opposite to that of the guy pendant 22A described above.

Figure 3:
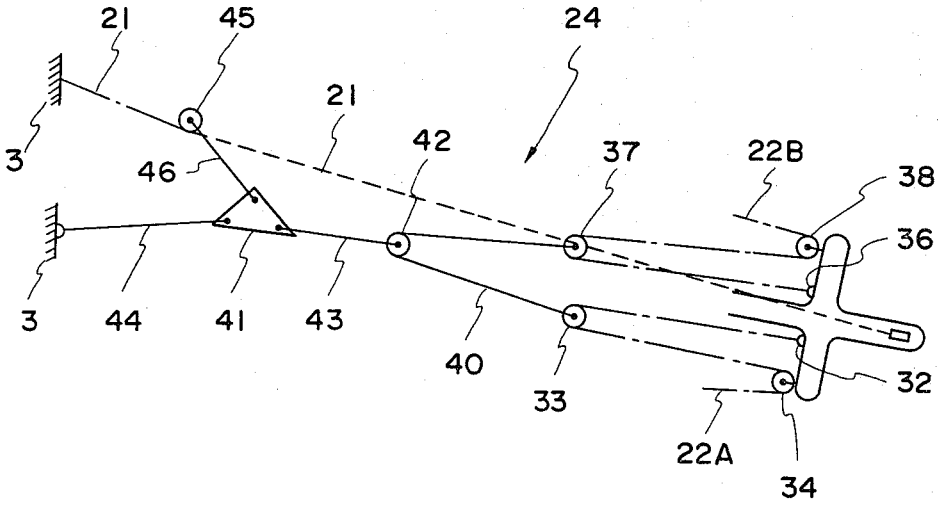
FIG. 3 is a plan view in enlarged scale showing a part of wirings in FIG. 1.

As shown in FIG. 3, a tension equalizing device 24 includes a delta plate 41 and an equalizing wire 40 is provided between both side guy pendants 22A and 22B. The delta plate 41 is suspended from the derrick post 3 by means of a strap wire 44, which is connected to the delta plate at first corner thereof. The delta plate 41 is provided with an equalizing sheave 42 which is connected to a second corner of the delta plate 41 by means of a strap wire 43. An equalizing wire 40 of relatively short length is entrained around the equalizing sheave 42, having one end connected to the sheave 33 around which the guy pendant 22A is entrained and the other end connected to the sheave 37 around which the guy pendant 22B is entrained. The delta plate 41 is provided with another sheave 45 which is connected to the third corner of the delta plate by means of a strap wire 46, and around which the topping lift wire 21 is entrained. As noted, tension of both guy pendants 22A and 22B will be equalized by action of the equalizing wire 40, which will move about the equalizing sheave 42 in see-saw manner, in case either guy pendant becomes slack. Moreover, any slackness of both guy pendants is absorbed by the topping lift wire 21 which is entrained about the sheave 45 on the delta plate 41, particularly in case both guy pendants becomes slack simultaneously.

Figure 4:
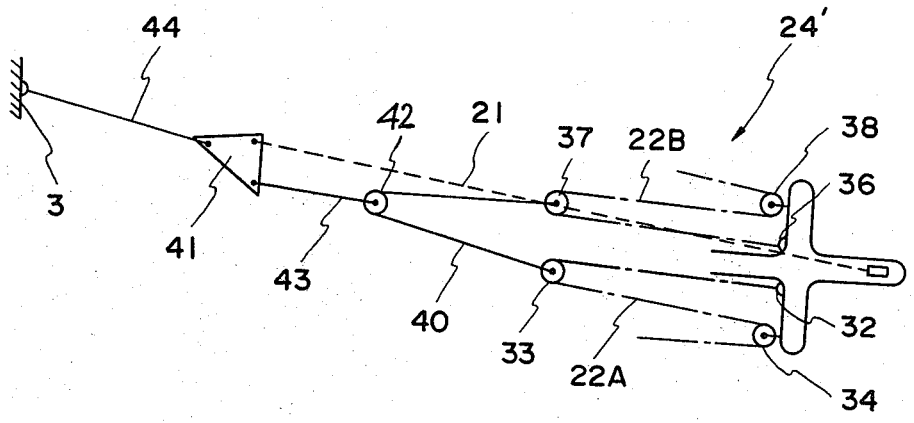
FIG. 4 is a plan view similar to FIG. 3 showing a modification of wirings in FIG. 3.

FIG. 4 shows a modification 24' of the tension equalizing device 24 in FIG. 3. This modification 24' differs from the tension equalizing device 24 in FIG. 3 only in that the delta plate 41 is directly connected to the end of the topping lift wire 21 in the third corner.

Figure 5:
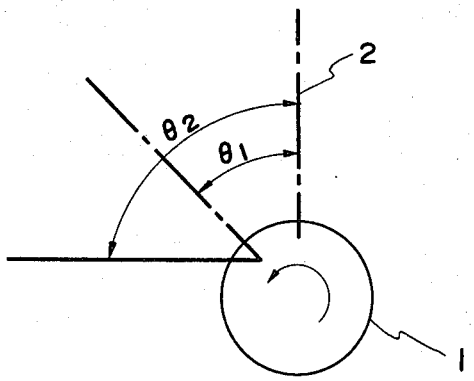
FIG. 5 is a plan view showing operation of the marine derrick in FIG. 1.

As shown in FIG. 5, the derrick boom 2 according to the present invention will be swung or slewed toward desired position by an angle of $\theta_2$ in unit time whereas the prior art derrick boom, such as the boom manoeuvered merely by guy pendants, is swung only an angle of $\theta_1$ in the same period of time. In other words, the derrick boom 2 of this invention is brought to the desired position much faster than the prior art derrick boom. As described hereinabove, since the top end of the derrick boom is brought into desired cargo hoisting position by slewing movement of the boom relative to the turntable by the guy winch superposed upon turning motion of the turn table, the angle of swing of the boom relative to the turntable is substantially reduced thereby alleviating undue stress occurring into the boom when it is swung in cargo carrying condition. Hence, conventional reinforcement members mounted on the boom may be eliminated.

Since the turn table is operatively connected to the drive shaft of the guy winch, there will be no need of separate actuating means specifically intended for the turn table. Hence, according to the present invention, the marine derrick arrangement improving the efficiency of cargo handling operation is constructed at a small cost.

According to the present invention, the tension equalizing device for the guy pendants will eliminate slackness of any one of both guy pendants so as to have both guy pendants maintained in readily operable condition at all times for controlling the boom once the guy winch is operated. Also, both guy pendants maintained taut at all times will carry a load on the derick boom to some extent thereby serving to eliminate the conventional reinforcement members mounted on the derrick boom.

What is claimed is:

1. A marine derrick comprising
a rotatably mounted turntable,
a derrick boom pivotally attached to said turntable,
a derrick post affixed to said turntable,
a guy winch,
a pair of guy pendants entrained on said guy winch, each guy pendant being connected to said derrick boom for slewing said derrick boom relative to said turntable,
a motor,
means including a driveshaft for interconnecting said motor and said guy winch,
means including gear means for interconnecting said driveshaft and said turntable such that operation of said motor produces slewing movement of said derrick boom relative to the turntable superposed on rotating movement of the turntable,
a topping lift winch on the turntable with a topping lift wire passing over the derrick post and being connected to the derrick boom,
a cargo winch on the turntable with a cargo fall passing over the derrick post and the derrick boom,
power cable means including a power cable and a ring-shaped cable holder concentric to the turntable fixedly mounted around the outer periphery of the turntable and having means forming an annular recess for receiving the power cable in coiled condition around the turntable, and
a tension type winding drum mounted on the turntable and adapted to wind and unwind the power cable in said cable holder, one end of the power cable being held on the drum and being connected to the topping lift and cargo winches on the turntable.

2. A marine derrick as described in claim 1 further comprising guy pendant tension equalizing means including
a delta plate suspended from the top end of the derrick post,
a first sheave connected to said delta plate,
a topping lift wire entrained on said first sheave,
a second sheave connected to said delta plate, an equalizing wire entrained around said second sheave, a third sheave connected to one end of said equalizing wire and having one of the guy pendants entrained thereon, and a fourth sheave connected to the other end of said equalizing wire and having the other guy pendant entrained thereon.

3. A marine derrick described in claim 1, wherein the derrick post is affixed to said turntable diametrically opposite said derrick boom, and the guy pendant winch is located between the derrick post and the derrick boom.

* * * * *